US005886287A

United States Patent [19]

Will et al.

[11] Patent Number: 5,886,287

[45] Date of Patent: Mar. 23, 1999

[54] GUIDANCE INFORMATION ANALYZER

[75] Inventors: Albert S. Will, Bethesda; Robert R. Wilson, Chillum; George F. Fortin, Bowie, all of Md.

[73] Assignee: The United States of America as represented by the Secretary of the Navy, Washington, D.C.

[21] Appl. No.: 459,131

[22] Filed: May 26, 1965

[51] Int. Cl.[6] ..... F42C 15/44; F42C 11/06

[52] U.S. Cl. ..... 102/220; 102/264

[58] Field of Search ..... 102/70.2, 200, 102/218, 220, 206, 264; 307/88.5

[56] References Cited

U.S. PATENT DOCUMENTS

| | | | |
|---|---|---|---|
| 3,067,684 | 12/1962 | Euker et al. | 102/206 |
| 3,088,410 | 5/1963 | Taylor | 102/211 |
| 3,123,002 | 3/1964 | Spool | 102/209 |
| 3,153,520 | 10/1964 | Morris | 102/215 |
| 3,218,470 | 11/1965 | Padgett et al. | 326/125 |
| 3,225,695 | 12/1965 | Kapp et al. | 102/220 |

OTHER PUBLICATIONS

Principles of Guided Missile Design, Van Nostrand Co., Inc., N.J., pp. 318–323, 1956.

*Primary Examiner*—Charles T. Jordan
*Assistant Examiner*—Christopher K. Montgomery

[57] ABSTRACT

A gating circuit for a missile guidance system having a capacitor for supplying the output signal together with a plurality of silicon controlled rectifiers for applying or removing a supply voltage to the capacitor.

4 Claims, 1 Drawing Sheet

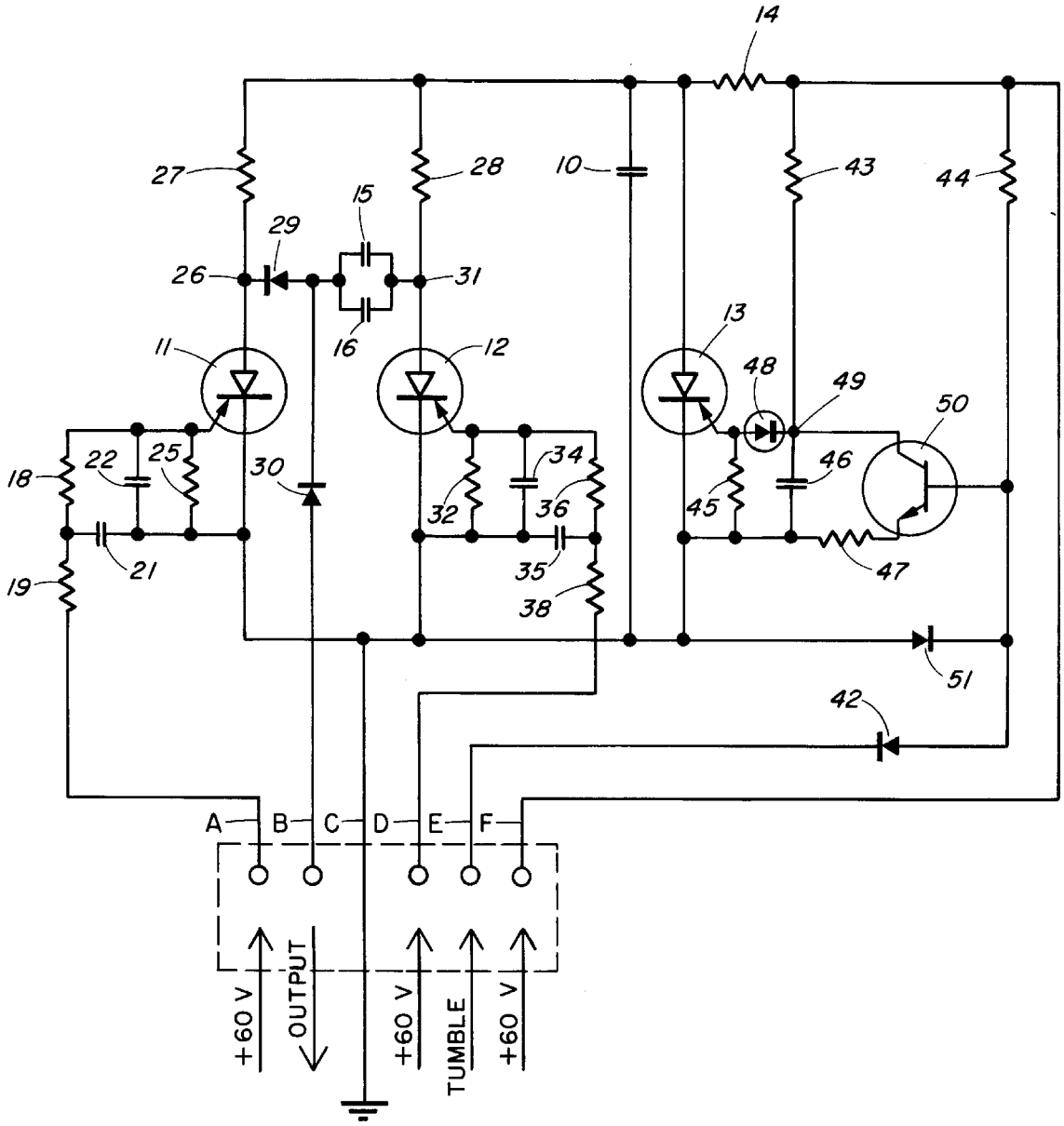
14
27
28
10
43
44
15
29
26
31
16
11
12
13
48
49
50
18
22
25
30
34
46
32
36
45
21
35
47
19
38
51
42
A
B
C
D
E
F
+60 V
OUTPUT
+60 V
TUMBLE
+60 V

GUIDANCE INFORMATION ANALYZER

The invention described herein may be manufactured and used by or for the Government of the United States of America for governmental purposes without the payment of any royalties thereon or therefor.

This invention relates to a guided missile fuzing system and more particularly to a guidance analyzer circuit in a missile system responsive to accept and discriminate guidance signals generated for safing purposes.

The invention to which the present application is directed was developed as part of the SUBROC weapon system although it will be clear from the detailed description to follow that it may be employed with any ordinary missile using an inertial guidance system. The SUBROC missile is an antisubmarine weapon provided with a nuclear warhead and designed to be launched from a torpedo tube of an attack submarine, thereafter to emerge from the water and go through an air boost phase depending upon the selected range, during which it is directed to the target area by the guidance system, and then to re-enter the water at the target.

In missile guidance systems, a problem arises in providing safety assurance that the missile will be dudded when certain conditions are either fulfilled or are not fulfilled in a proper sequence. Using the SUBROC missile, for which the subject safing system was concerned, as an example, if the missile has an altitude at apogee which is less than a predetermined minimum altitude which is sufficient to permit it to fly to the desired range, the missile will fall short of the target. If at apogee, the guidance package computed distance to the target is not greater than a predetermined calculated minimum, the combined output from the guidance accelerometers and integrators may have excessively high outputs which would result in the missile diving in short of the target. At some time just prior to the missile reaching the timer arm zone, the distance $X_c$ (range along the canted coordinate) should decrease nearly to zero on a normal trajectory. For $X_c$ too great at this point, the trajectory is abnormal and will either undershoot or overshoot the target. Also when the missile is off course in the azimuth direction or becomes erratic due to gyro tumble, the missile may be dangerous and should be dudded.

In the past fuzing systems have incorporated self-destruction systems which are actuated by some abnormal flight condition, or they have been made harmless by using special gating circuits which permit the missile to be armed only after a predetermined sequence of operations. One such gating device contemplates magnetic cores with a plurality of individual windings acting as gates to the operating inputs. The present invention is a novel gating circuit including solid state elements and a capacitor which supplies the arming output signal when certain criteria in a proper sequence are fulfilled.

Accordingly, it is an object to provide a novel condition responsive gating circuit which has an output only when several events occur in a predetermined sequence.

It is another object to provide a guidance information analyzer circuit for a missile system which will cause the missile fuze to be dudded when the guidance system of the missile is off the normal trajectory by a predetermined amount.

It is still another object to provide a gating circuit having a charging capacitor for a guidance information analyzer system which is fail-safe, which does not provide firing energy for an arming output until the proper guidance signal is received at missile apogee, which does not charge the firing capacitor via an explosive switch bridge wire, which allows platform gyro tumble contacts to remain closed for a short period to allow for possible guidance recovery prior to dudding and which will generate an arm signal when signals are received from guidance in the proper sequence.

These and other objects of the invention will become apparent to those skilled in the art as the disclosure is made in the following description of one embodiment of the invention as illustrated in the accompanying sheet of drawing in which:

The FIGURE illustrates a circuit diagram of a guidance information analyzer.

The circuit shown in the drawing has been designed to be part of a submarine nuclear missile system. The Guidance Information Analyzer accepts three signal inputs from the Guidance Control section (not shown) and under certain conditions generates an output signal to the output of the arming section (not shown) of the missile system. At Rocket Motor ignition, a plus 60 volts is applied to lead F of the GIA to provide power to the circuit. At apogee, when minimum altitude and a specific $X_c$ relationship have been met, the first plus 60 volt signal is supplied by Guidance Control over lead A. When the $X_c$ and Y coordinates are within established limits near zero, a plus 60 volts, which is keyed through the variable timer (not shown) in the Arming and Safing section, is applied by Guidance Control over lead D. This second signal generates a safe-to-arm switch closure by discharging capacitors 15 and 16 over lead B to an explosive switch (not shown) in the Arming and Safing section. If any gyro in the stable platform complex should lose reference, the gimbal affected will be driven to its stops. When the contact with this stop is greater than one and one-half milliseconds, the GIA which is monitoring all gimbal stops over lead E, will generate an inhibit function within the GIA by safely discharging capacitors 15 and 16 through a high resistance and also preventing a charge from accumulating on these capacitors for the remainder of the missile trajectory.

For normal operation to arm the system, 60 volts is applied through resistors 14 to charging capacitor 40, which controls the voltage rise time across silicon control rectifiers 11, 12 and 13, maintaining them in the off position. Upon receipt of the apogee signal over lead A through the filter network composed of resistors 18, 19 and 25 and capacitors 21 and 22, silicon control rectifier 11 is triggered to the on state. When silicon control rectifier 11 conducts, the voltage at point 26 between resistor 27 and diode 29 drops to nearly ground potential. Capacitors 16 and 15 then charge through resistor 28 and diode 29 to provide the energy source for the safe-to-arm output signal.

Silicon control rectifier 12 is triggered to an on state when a 60 volt signal is received over lead D through the filter network consisting of resistors 32, 36 and 38 and capacitors 34, 35. When silicon control rectifier 12 conducts, the voltage at point 31 between resistor 28 and capacitor 15 and 16 drops to ground potential discharging capacitor 15 and capacitor 16 through silicon control rectifier 12 to ground and providing an output signal from lead B through diode 30 to an explosive switch (not shown) in the arming section of the missile system.

Filter network inputs to the silicon control rectifiers 11 and 12 are necessary to prevent triggering on spurious signals, such as induced high frequence ripple and induced spikes. If the sequence of the signals on leads A and D are reversed there is no output since the capacitor bank will not be charged.

A safe-to-arm signal will not be generated if a platform gyro tumble ground switch closure signal is detected on lead E by the analyzer circuit. When 60 volt power is initially supplied to the circuit by way of resistors 44, transistor 50 is triggered to its on position; in this state the voltage at point 49 between Zener diode 48 and resistor 43 is maintained at 4 to 5 volts.

Capacitor 46 is connected between the collector of transistor 50 and resistor 47 in the emitter branch of transistor 50. On gyro tumble, a contact (not shown) in the guidance section is closed, grounding the tumble input circuit E, cutting off transistor 50 and allowing capacitor 46 to charge through resistor 43 toward the 60 volt supply. After a duration greater than 1.5 milliseconds determined by the RC time constant, capacitor 46 has charged to the breakdown voltage of Zener diode 48 and thus provides triggering current to the gate of silicon control rectifier 13. The voltage at the point between silicon control rectifier 13 and resistor 14 then drops to ground, effectively removing the power from the rest of the information analyzer circuitry, thus preventing generation of an output signal to arm the explosive switch.

Diode 42 and diode 51 are included for isolation purposes in the system so that a plurality of guidance information components may be used with a common tumble circuit.

The system is fail-safe since loss of power, wrong signal sequence, and component failures result in no safe-to-arm output signal being generated. The firing energy required for an arming output is not available until the first signal from guidance is received at missile apogee and the circuitry of the firing capacitor is such that the capacitor is not charged via an explosive switch bridge wire thereby isolating the bridge wire from the triggering and firing circuitry. A gyro tumble signal can appear in any sequence or any time during the missile flight prior to the information analyzer output and accomplish effective dudding, but the circuit requires the platform gyro tumble contacts to remain closed for a short minimum period of time to allow for probable recovery if a gimbal barely brushed against a stop contact.

It is apparent therefore that a novel guidance information analyzer circuit has been developed for a missile system which will cause the missile fuze to be dudded when the missile is off the normal missile trajectory or is behaving erratically, in which a gating circuit having a charging capacitor is utilized to provide an output signal only when it is safe to arm the system.

It should be understood, of course, that the formal disclosure relates to only one embodiment of the invention and that numerous modifications and alterations may be made therein without departing from the spirit and scope of the invention as supported by the appended claims. For example, explosive switches may be used in the information analyzer circuitry.

What is claimed and desired to be secured by Letters Patent of the United States is:

1. A condition responsive circuit for a guidance information analyzer in a missile system for providing an output safe-to-arm signal only when predetermined signals are received in a proper sequence without interruption, and comprising, in combination, a potential storage capacitor, a first silicon controlled rectifier, a second silicon controlled rectifier, and a third silicon controlled rectifier all normally biased to off position, a first filter circuit connected to said first silicon controlled rectifier responsive to a first signal input for triggering said first silicon rectifier to an on position, a second filter circuit connected to said second silicon control rectifier responsive to a second signal when received at a predetermined time after said first signal for triggering said second silicon rectifier to an on position, a capacitor charge and discharge circuit connected between said first and second silicon controlled rectifiers, said charge and discharge circuit being in a charging condition with said potential storage means when said first silicon controlled rectifier is in an on position; said charge and discharge circuit being in a discharge condition with said second silicon controlled rectifier when said second silicon rectifier is in an on position; said capacitors when discharging providing an output safe-to-arm signal, and inhibit means comprising said third silicon rectifier, a Zener diode, a capacitor, and a transistor, said transistor having an input for an inhibitory signal and an output connected across said capacitor, said Zener diode connected to said capacitor and the collector of said transistor providing a trigger pulse to said silicon control rectifier placing it in an on position when said inhibitory signal is received; said third silicon controlled rectifier providing a shunt for said potential storage means whereby the receipt of said inhibitory signal prevents said charge and discharge circuit from providing a safe-to-arm signal.

2. The apparatus of claim 1 further comprising a diode connected in series with said discharge circuit and said charge and discharge circuit includes two capacitors connected in parallel with each other.

3. A condition responsive gating circuit for a missile guidance system comprising, a discharge means for producing an output signal when input signals are received in a predetermined sequence, a first filter for detecting a first signal input, a first silicon controlled rectifier connected between said first filter and said discharge means responsive to place said discharge means in a charging position when said first signal is received, a second filter detecting a second input signal, a second silicon controlled rectifier connected between said discharge means and said second filter responsive to place said discharge means in a discharge position when said second signal is detected a predetermined time after said first signal, and additional signal detection means having a third silicon controlled rectifer responsive to a third input signal for preventing the discharging of said discharge means if said third signal is received before said second signal input is received in said predetermined sequence.

4. The apparatus of claim 3 wherein said additional detecting means comprises a transistor having an input for receiving said third signal, a capacitor connected to its output, and a Zener diode for supplying a trigger pulse to said third gate when said third signal is received.

* * * * *